US006582347B2

(12) United States Patent
Smith

(10) Patent No.: US 6,582,347 B2
(45) Date of Patent: Jun. 24, 2003

(54) ABDOMINAL EXERCISE DEVICE AND METHODS OF USE

(75) Inventor: Detlev F. Smith, Fairlawn, OH (US)

(73) Assignee: Fitness Quest Inc., Canton, OH (US)

( * ) Notice: Subject to any disclaimer, the term of this patent is extended or adjusted under 35 U.S.C. 154(b) by 0 days.

(21) Appl. No.: 09/749,711

(22) Filed: Dec. 27, 2000

(65) Prior Publication Data

US 2002/0082150 A1 Jun. 27, 2002

(51) Int. Cl.[7] ..... A63B 26/00; A63B 71/00
(52) U.S. Cl. ..... 482/140; 482/907; 482/91
(58) Field of Search ..... 482/140, 907, 482/908, 91, 146, 34, 79, 80; 273/440; 280/87.041–87.042; 472/13, 110, 114, 128

(56) References Cited

U.S. PATENT DOCUMENTS

| | | | | |
|---|---|---|---|---|
| 3,589,720 A | | 6/1971 | Agamian | |
| 3,752,475 A | | 8/1973 | Ott | |
| 3,809,393 A | | 5/1974 | Jones | |
| 4,136,867 A | | 1/1979 | Wilkin | |
| 4,595,197 A | | 6/1986 | Hagstrom et al. | |
| 4,911,440 A | * | 3/1990 | Hyman et al. | 272/146 |
| 5,004,229 A | | 4/1991 | Lind | |
| 5,261,866 A | | 11/1993 | Mattox | |
| 5,499,961 A | | 3/1996 | Mattox | |
| 5,518,483 A | | 5/1996 | Oswald | |
| 5,669,864 A | * | 9/1997 | Brister | 482/132 |
| 5,725,463 A | | 3/1998 | Colonello et al. | |
| 5,921,901 A | | 7/1999 | Palacios | |
| 6,017,296 A | | 1/2000 | Tang et al. | |
| 6,017,297 A | * | 1/2000 | Collins | 482/146 |

* cited by examiner

*Primary Examiner*—Nicholas D. Lucchesi
*Assistant Examiner*—Lori Baker Amerson
(74) *Attorney, Agent, or Firm*—Sand & Sebolt

(57) ABSTRACT

A device for exercising abdominal muscles comprising a platform having an upper surface and a lower surface adapted for omni-directional motion, a pair of generally longitudinal limb supporting areas positioned on said upper surface, a pair of lateral hand grips each of said pair extending from the upper surface of the platform and disposed in opposed relation laterally and outwardly from one of said limb supporting areas, and a front hand grip extending from the upper surface of the platform and disposed generally forward of the limb supporting areas. Methods for using this device are also disclosed.

47 Claims, 12 Drawing Sheets

FIG-3
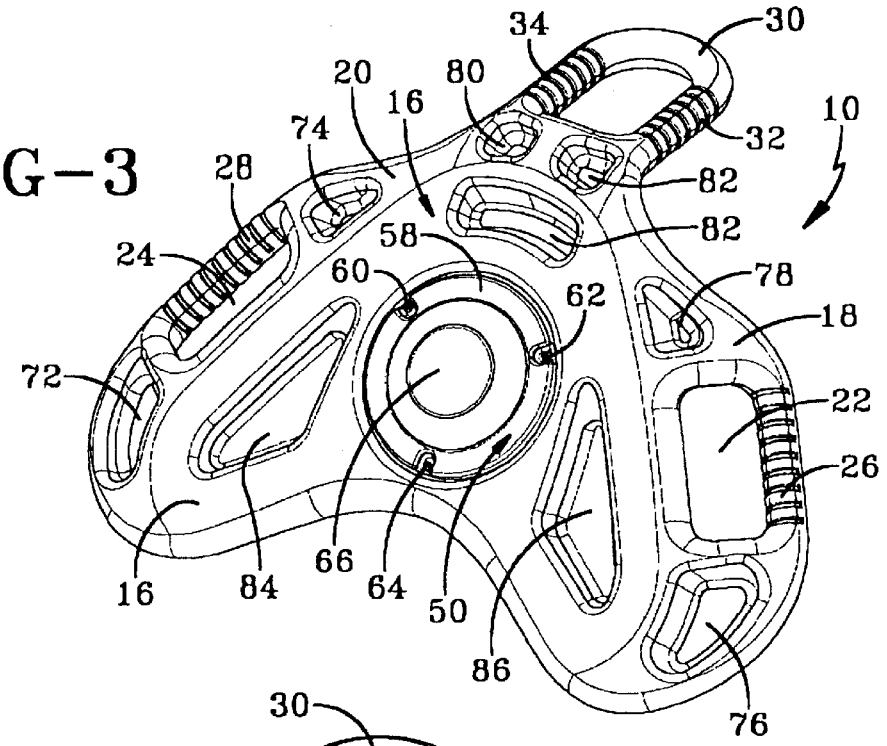
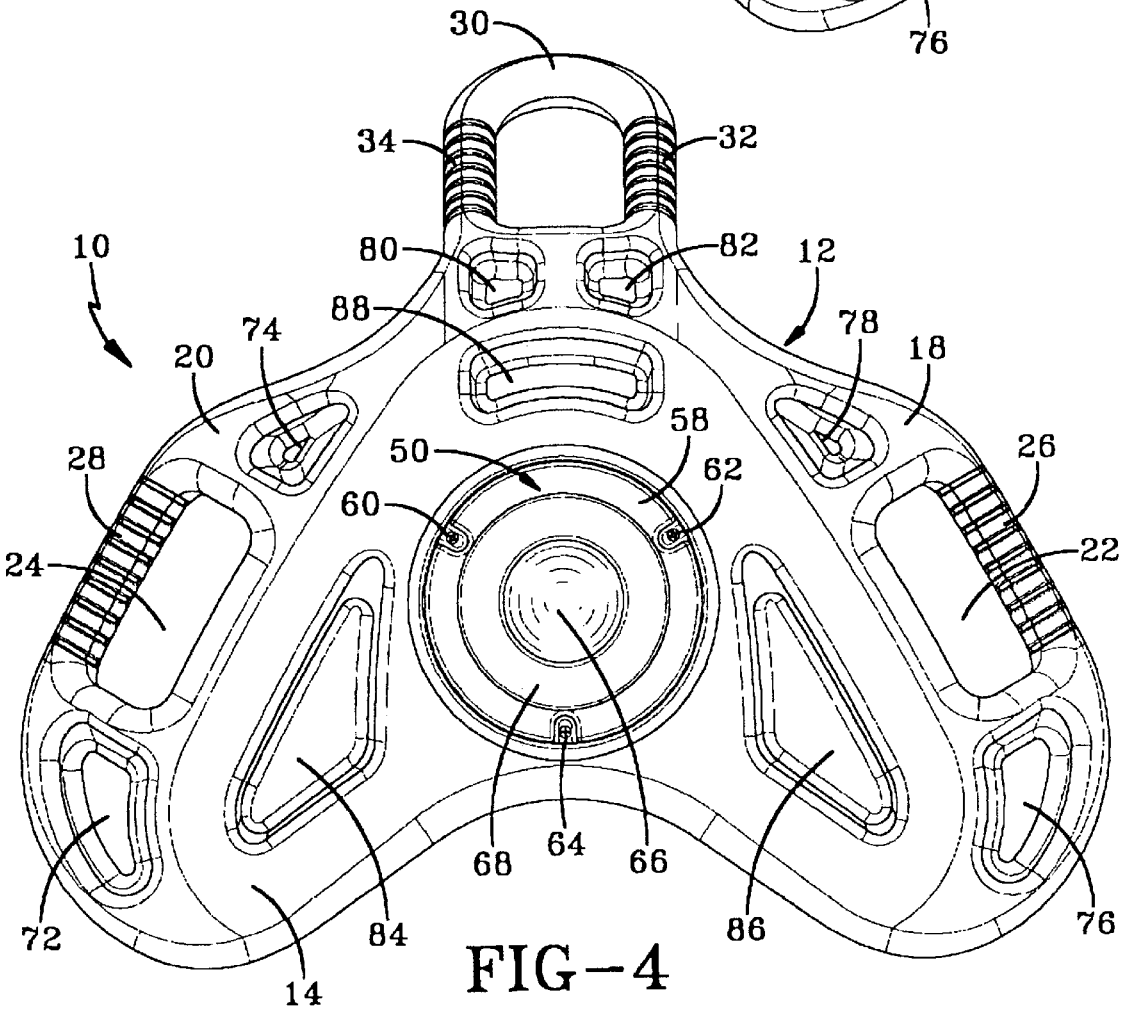
FIG-4

ABDOMINAL EXERCISE DEVICE AND METHODS OF USE

BACKGROUND OF THE INVENTION

1. Technical Field

The present invention relates to exercise devices and more particularly, to exercise devices which are rolled or slid across a surface by the user. Still more particularly, the present invention relates to devices for exercising the abdominal muscles.

2. Background Information

In the exercise of abdominal muscles, it has commonly been the practice to perform such exercises along the range of motion which coincides with the centerline of the exerciser's body. Conventional sit-up and crunch exercises are examples of exercises which tend to follow the centerline of the exerciser's body. A number of prior art exercise devices also restrict abdominal exercises to this plane of motion. Such exercises may have disadvantages in that they do not exercise all the major abdominal muscle groups; the transverse, the rectus, and the oblique.

U.S. Pat. No. 3,589,720 to Agamian, for example, discloses an exercise apparatus having a hand rail carriage, a foot slider carriage and longitudinal track guide means along with the hand rail carriage and foot slider carriage are slidable relative to one another. This apparatus may also include means for retaining an adjustable drag or resistance between the hand rail carriage and the foot rail carriage.

Another exercise device which restricts the user's motion generally to the plane of the centerline of the user's body is U.S. Pat. No. 5,921,901 to Palacios. This patent discloses a push-pull type of exercise device for exercising a person's abdominal muscles including a track unit formed by a track board having an upper, body supporting surface extending between front and rear ends; and elongate, track-supporting base board for extending horizontally across a floor; a knee support on the base board adjacent the rear end of the track board; and, a support member for supporting the track board pivotally connected to overlie the base board at selected elevations. A hand-grip carriage unit with a pair of hand grips and an elbow support aligned rearward of the supporting surface for reciprocal rolling movement therealong. An anchoring unit for a person's legs or hands, alternatively, is releasably mounted to the front end of the track board, when elevated.

Other abdominal exercise devices, while not strictly limiting the user's motion to the plane of the centerline of his/her body, are based on a wheel and axle arrangement which requires the user to grip the lateral handles with his/her hands and move the wheel back and forth. While such arrangements do not prohibit a lateral motion, they are not easily adapted to allow the user to move in a forward and rearward path which is angularly disposed to the centerline of his/her body. Furthermore, such devices generally require the user to grip handles immediately adjacent to the wheel which are collinear with the axis of the wheel.

An example of such a wheeled exercise device is U.S. Pat. No. 3,752,475 to Ott which discloses an exercise wheel which is rotatable about a generally central axis. A spring is operatively associated with the wheel and axle increasing resisting rotation of the wheel.

Another wheel and axle exercise device is disclosed in U.S. Pat. No. 6,017,296 to Tang, et al. In this device, a housing is provided with a receiving compartment, a grip rod which is put through the housing such that both longitudinal ends thereof are left out in the outerside of the housing, a main wheel rotatably mounted on the grip rod such that the main wheel is located in the receiving compartment of the housing, two auxiliary wheel sets pivoted in the housing such that they are linked with the main wheel, and at least one elastic recovery device disposed between the main wheel and the housing for providing the main wheel with a recovery force enabling the main wheel to return to its original angular position.

An exercise device for the abdominal muscles which appears to facilitate motion, not only along the centerline of the user's body, but along paths angularly disposed to the left and right of such centerline is disclosed in U.S. Pat. No. 3,809,393. This patent discloses an exercise device in the form of a handle supported by at least three swivel castors and adapted to be moved about the floor while supporting the upper body of the person in use. The handle defines a longitudinal axis around which the swivel castors are symmetrically disposed. While this patent appears to allow a certain degree of lateral motion, it appears to have a grip for only one hand. Two devices, therefore, appear to be required for its use. In exercising with such a device, the user forgoes the possibility of having one hand support the other.

A need, therefore, exists for a simple, inexpensive and easily stored device for exercising abdominal muscles which can be easily gripped by the user with two hands to allow front and back motion not only along the plane of the centerline of the user, but along directions of motions disposed angularly to the left and the right of that centerline.

SUMMARY OF THE INVENTION

It is an object of the present invention to provide a device for exercising abdominal muscles which is adapted to use both along the plane of the centerline of the user and to the left and right of such centerline to exercise all of the major abdominal muscle groups.

It is a further object of the present invention to provide such an exercise device which the user may grip with both hands in a mutually supporting manner.

It is a further object of the present invention to provide an exercise device which is adapted to a number of different exercises in a number of alternate positions so as to allow the user to exercise the full range of his/her abdominal muscle groups and other muscles and to provide him/her with a variety of enjoyable exercise routines.

It is another object of the present invention to provide an exercise device which may be easily and inexpensively manufactured.

It is still another object of the present invention to provide an exercise device which may be used in the home and easily stored in a space efficient manner when not in use and which is adapted to be easily carried when the user is traveling.

This and other objects and advantages of the present invention will be apparent from the present invention which is a device for exercising abdominal muscles of a user comprising a freely movable platform having an upper surface and a lower surface. The device is adapted to be moved on said lower surface, and there are handles on said upper surface for allowing the user to grip said platform with both of his/her hands.

Also encompassed by the present invention is a device for exercising abdominal muscles comprising a platform having an upper surface and a lower surface adapted for omnidirectional motion, a pair of generally longitudinal limb supporting areas positioned on said upper surface, a pair of lateral hand grips each of said pair extending from the upper surface of the platform and disposed in opposed relation laterally and outwardly from one of said limb supporting areas, and a front hand grip extending from the upper surface of the platform and disposed generally forward of the limb supporting areas.

The present invention also encompasses a method for a person to exercise abdominal muscles comprising the steps of first providing a platform having an upper surface and a lower surface, wherein said upper surface has hand receiving means for both of said hands or forearm receiving means of both of said forearms of said person and said lower surface is adapted for motion on said substrate in a plurality of directions. Then the person engages the hand receiving means with both of his/her hands or engages the forearm receiving means with both of his/her forearms and positions his/her knees in a stationary position on the substrate in an arched back position. The person then moves the platform on the stationary substrate in a forward direction generally coplanar with his/her body centerline to an extended back position. The person then moves the platform on the stationary substrate in a rearward direction generally opposite from the direction traveled in step to an arched back position. The person then moves the platform on the stationary substrate in a forward direction generally opposite to said direction traveled in the previous step. The person then moves the platform on the stationary substrate in a generally forward direction which is angularly disposed to the direction traveled in the previous step and to the centerline of his/her body to an extended back position. The person then moves the platform on the stationary substrate in a rearward direction generally opposite to the direction traveled in a previous step to an arched back position. Preferably the person then moves the platform angularly forward to the opposite side of the centerline of his/her body and then rearwardly again.

Also encompassed by the present invention is another method for exercising abdominal muscles in which a platform having an upper surface and a lower surface and where on the upper surface has knee receiving means is provided. The person positions his/her hands or forearms on a stationary surface and positions his/her knees on the knee receiving means and assumes an arched back position. The person then moves the platform in a direction rearwardly, generally coplanar with his/her body's centerline to an extended back position. The person then moves the platform forward on the stationary substrate with his/her knees in generally an opposite direction to return to an arched back position. The person then moves the platform on the stationary substrate in a generally rearward direction which is angularly disposed to the centerline of the person's body to an extended back position. The person then moves the platform on the stationary substrate in a forward direction opposite to the angularly disposed position to an arched back position. Preferably, the person then moves the platform angularly rearwardly to the opposite side of his/her body's centerline and then forwardly again.

Also encompassed within the present invention is a method of exercising abdominal muscles in which a person engages the hand receiving means on the platform with both of his/her hands or engages the forearm receiving means with both of his/her forearms and positions his/her knees on knee receiving means on the second platform. From an arched back position, the first platform is extended in a forward direction and the second platform is extended in a rearward direction to a generally extended body position. The person then moves the first platform rearwardly and the second platform forwardly to again achieve an extended back position. From this position, the user moves the first platform rearwardly and the second platform forwardly to an arched back position.

Also encompassed within the scope of the present invention is a method in which the user positions his/her hands or forearms on the platform while the knees are positioned on the stationary substrate. The person then moves the platform laterally in one direction and then laterally in a reversed direction, preferably in an arcuate motion.

Also encompassed with the present invention is a method in which the person positions his/her hands or forearms on a stationary substrate and positions his/her knees on the platform. While maintaining his/her hands or forearms in a stationary position, the platform is moved laterally to one direction and then in the opposite direction, preferably in an arcuate motion.

BRIEF DESCRIPTION OF THE DRAWINGS

The preferred embodiment of the invention, illustrative of the best mode in which applicant contemplated applying the principles, is set forth in the following description and is shown in the drawings and is particularly and distinctly pointed out and set forth in the appended claims.

FIG. 3 is a bottom perspective view of the exercise device shown in FIG. 1;

FIG. 4 is a bottom plan view of the exercise device shown in FIG. 1;

DESCRIPTION OF THE PREFERRED EMBODIMENTS

Figure 1:
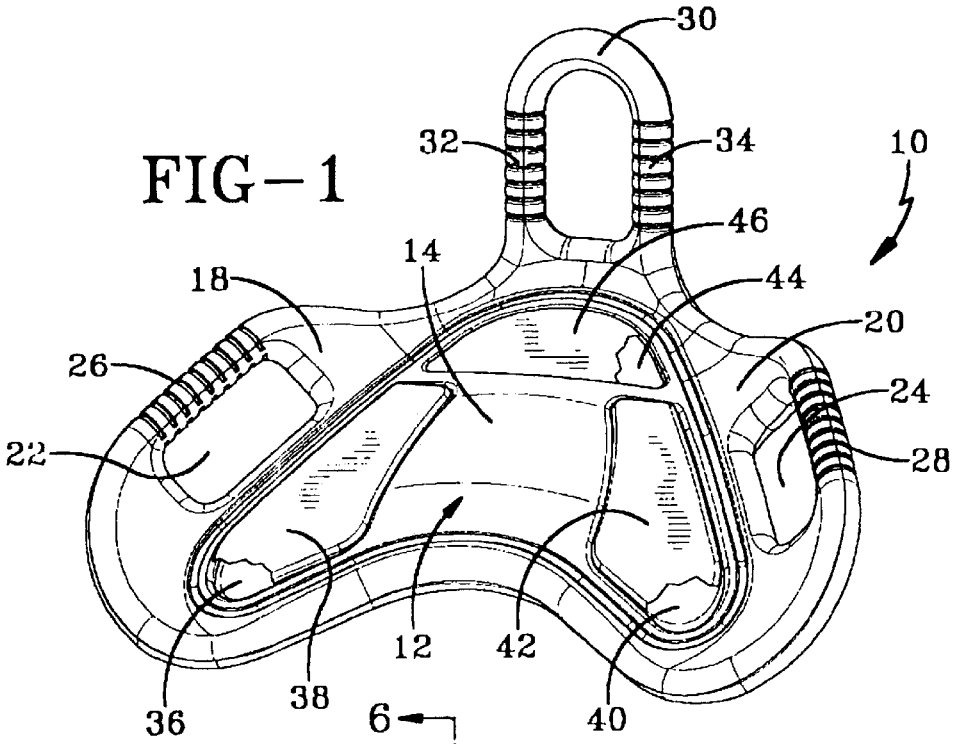
FIG. 1 is a top perspective view of an exercise device which is a preferred embodiment of the present invention.
Figure 2:
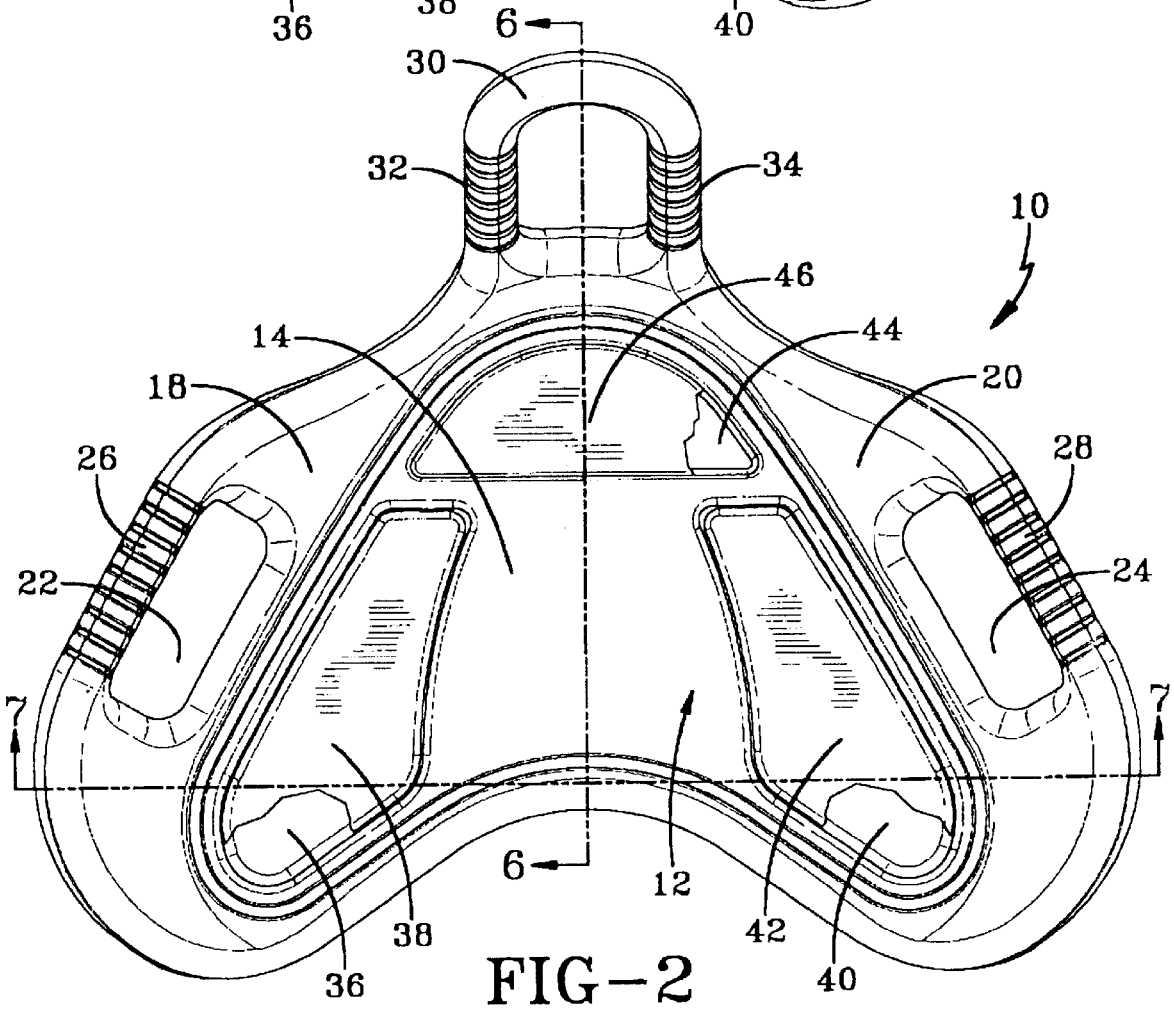
FIG. 2 is a top plan view of the exercise device shown in FIG. 1.
Figure 6:
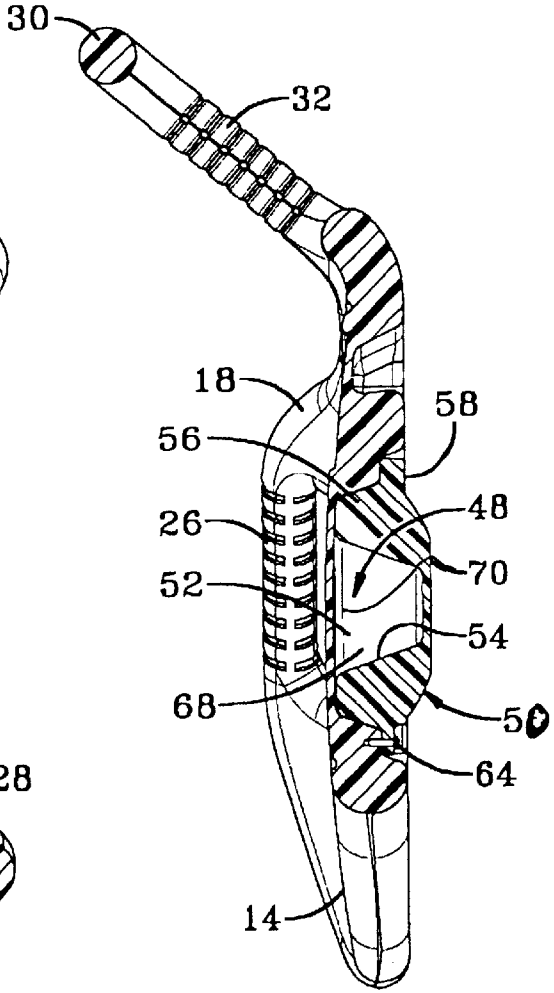
FIG. 6 is a cross sectional view through 6—6 in FIG. 2.
Figure 5:
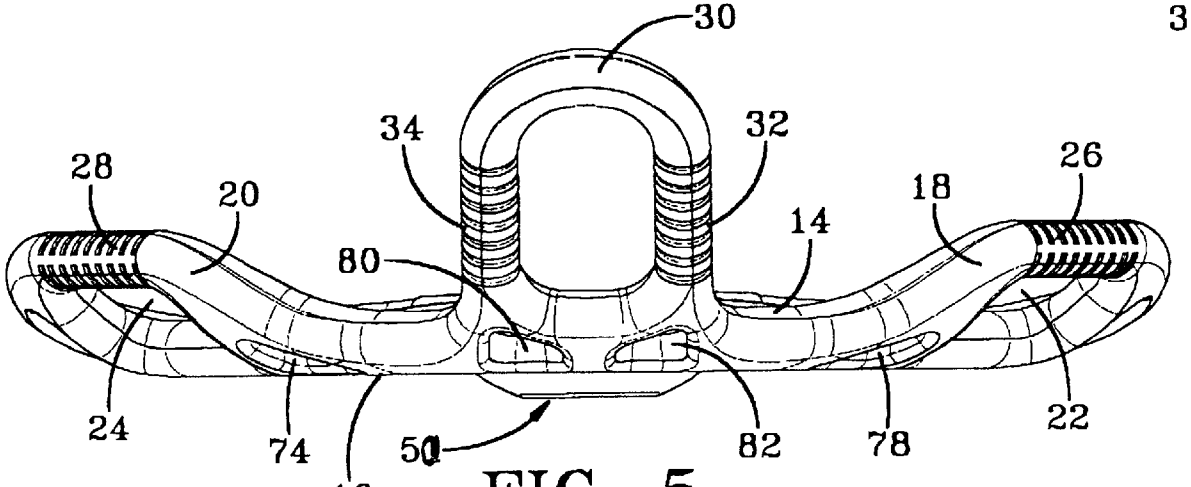
FIG. 5 is a front end view of the exercise device shown in FIG. 1.
Figure 7:
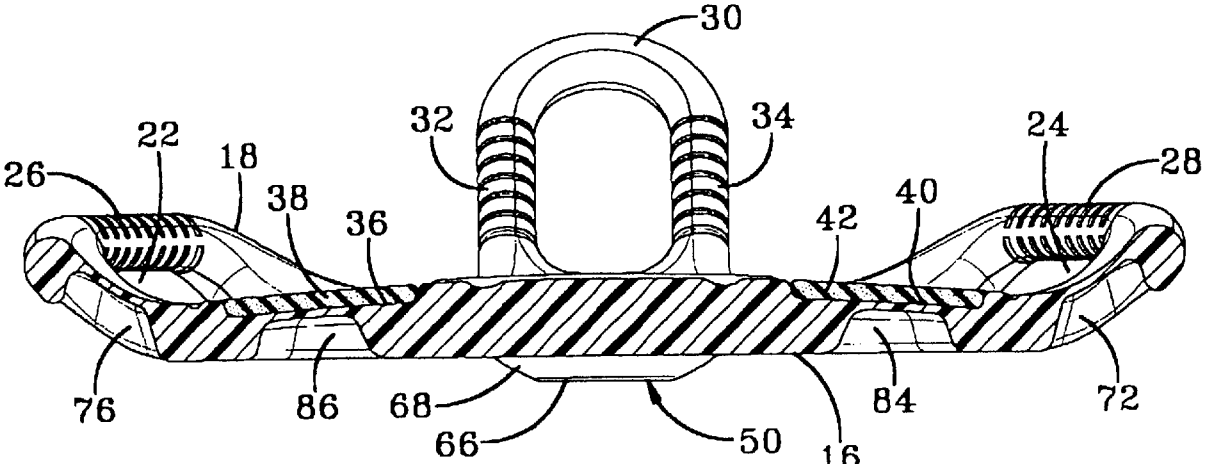
FIG. 7 is a cross sectional view through 7—7 in FIG. 2.

Referring to FIGS. 1–7, the device shown generally at numeral 10 comprises a platform 12 having an upper surface 14 and a lower surface 16. At the sides of the platform 12, lateral raised sections 18 and 20 extend upwardly and outwardly. Lateral raised section 18 and 20 have respectively lateral apertures 22 and 24 which form respectively lateral hand grips 26 and 28 on the lateral raised sections 18 and 20. Also extending upwardly and outwardly from the upper surface 14 there is a front arc 30 on which there are opposed front hand grips 32 and 34. Adjacent the lateral raised section 18 on the upper surface there is a recessed limb support area 32 on which a limb support pad 38 is superimposed. Adjacent the lateral raised section 20 on the upper surface 14 there is a recessed limb support area 40 on which a limb support pad 42 is superimposed. On the upper surface 14 there is also a front recessed hand support area 44 on which a front hand pad 46 is superimposed. On the lower surface 16 of the platform 12 there is an attachment recess 48 on which a sliding attachment 50 is attached.

This sliding attachment 50 has an interior central recess 52 which has an upwardly sloped peripheral wall 54. An inner shoulder 56 extends concentrically outwardly from the upwardly sloped peripheral wall 54. At the outer peripheral edge of the slide attachment 50, there is a peripheral rim 58. The sliding attachment 50 is fixed to the platform 12 by means of plastic fasteners 60, 62 and 64 which extend through this peripheral rim 58. On the lower side of the sliding attachment 50, there is a central sliding surface 66 with a peripheral downwardly sloped surface 68 interposed between the central sliding surface 66 and the peripheral rim 58. The entire sliding attachment rests on a recessed base surface 70 on the platform 12. On the lower surface 16 of the platform 12, there are also lateral ridge recesses 72, 74, 76 and 78. There are also front recesses 80 and 82 on the lower surface 16 of the platform 12 as well as bottom base recesses 84, 86 and 88.

It will be understood that the use of the sliding attachment 50 is optional, and that this attachment 50 may be removed by removal of the fasteners 60, 62 and 64, and the device 10 used in the same way as is otherwise described. In general, there will be more resistance to movement of the device 10 by the user when the sliding attachment 50 is used and less resistance when the attachment 50 is not used.

Figure 8A:
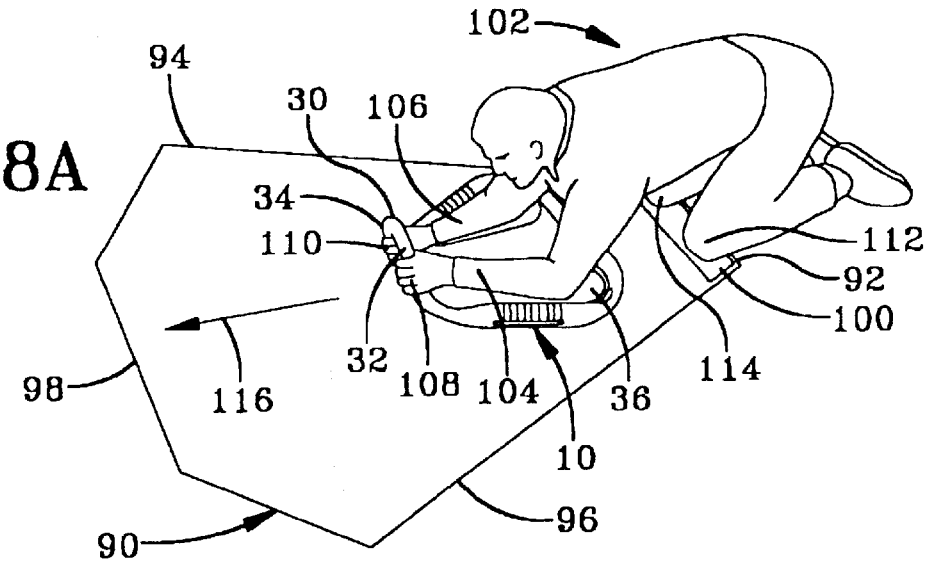
FIGS. 8A, 8B and 8C are sequential perspective views of a person using the exercise device shown in FIG. 1 which demonstrate its method of use.
Figure 8B:
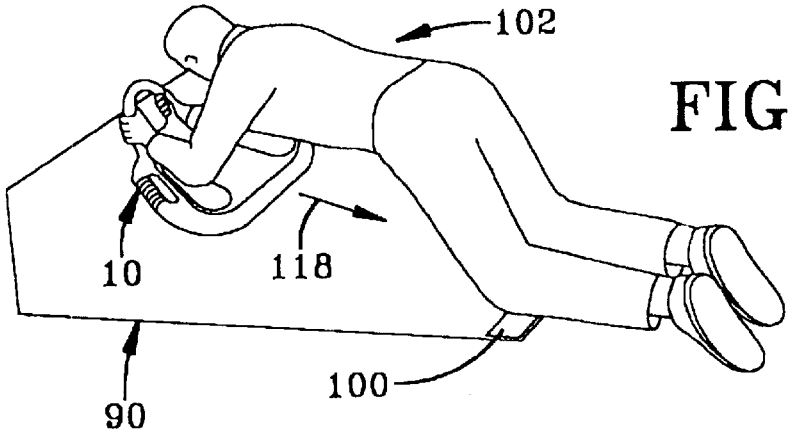
Figure 8C:
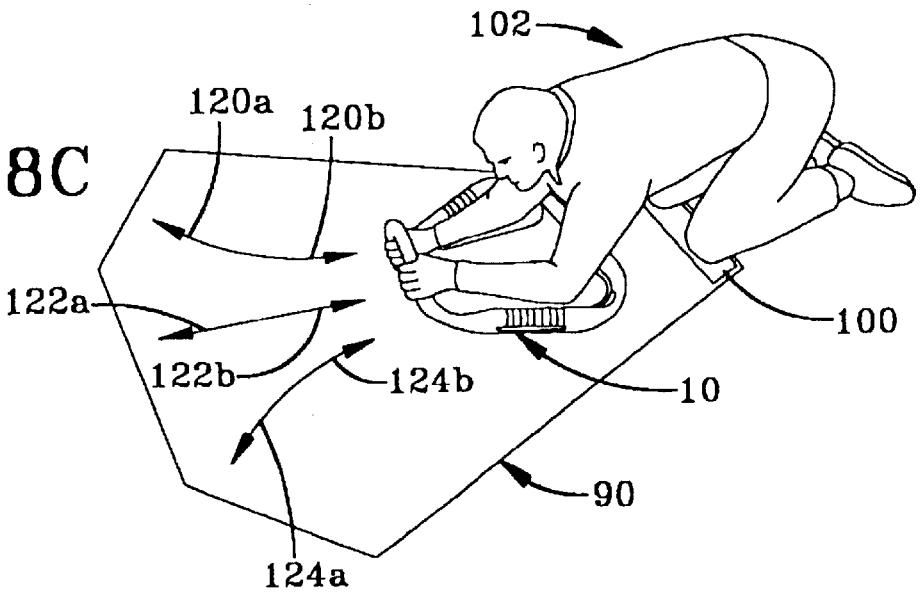

Referring to FIGS. 8A–8C, a method of using the device described above is illustrated. In this method, the device 10 is positioned on a sheet polyethylene or polypropylene mat shown generally at numeral 90. This mat 90 has a narrow base 92 with outwardly extending oblique sides 94 and 96 and a widened front side 98. A kneepad 100 is positioned on the mat 90 adjacent the narrow base side 92. A user 102 positions his/her forearms 104 and 106 respectively on the forearm receiving pads 36 and 38. The user 102 is thereby able to grip hand grips 32 and 34 on the front arc 30 with his/her hands 108 and 110, respectively. The user's knees 112 and 114 remain in a stationary position on the kneepad 100. In the first step in the method of using the device 10, the user moves forward generally in the direction of the centerline of his/her body as at arrow 116 in FIG. 8A. At the completion of this step 102, the user will have extended his/her body from the arched back position shown in FIG. 8A to the extended, nearly prone position shown in FIG. 8B. Once having reached the extended, nearly prone position shown in FIG. 8B, the user then slides the device rearwardly in the direction of arrow 118 along the centerline of his/her body until the arched back position shown in FIG. 8C is reached. Upon reaching this arched back position, the user then extends the device laterally and forwardly to the right of the centerline of his/her body in the direction of arrow 120A until the extended nearly prone position is again reached after which the user again slides the device 10 rearwardly in the direction of arrow 120B to the arched back position. The user then again extends the device 10 in a forward direction along the centerline of his/her body in the direction of arrow 122A. After the extended, nearly prone position is reached, the user then again moves the device 10 rearwardly in the direction of arrow 122B to the arched back position. Next, the user extends the device 10 forwardly and laterally at an angle to the left of arrow 122A in the direction of arrow 124A. Again, when the extended nearly prone position is reached, the user moves the device rearwardly in the direction of the reverse arrow 124B. This entire sequence may be repeated a plurality of times.

Figure 9A:
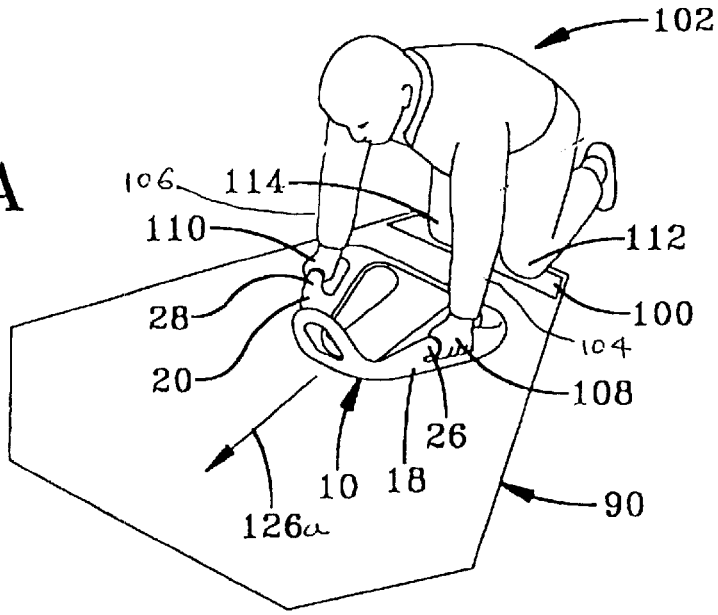
FIGS. 9A, 9B and 9C are sequential perspective views of a person using the exercise device shown in FIG. 1 which demonstrate its method of use in an alternate preferred way.
Figure 9B:
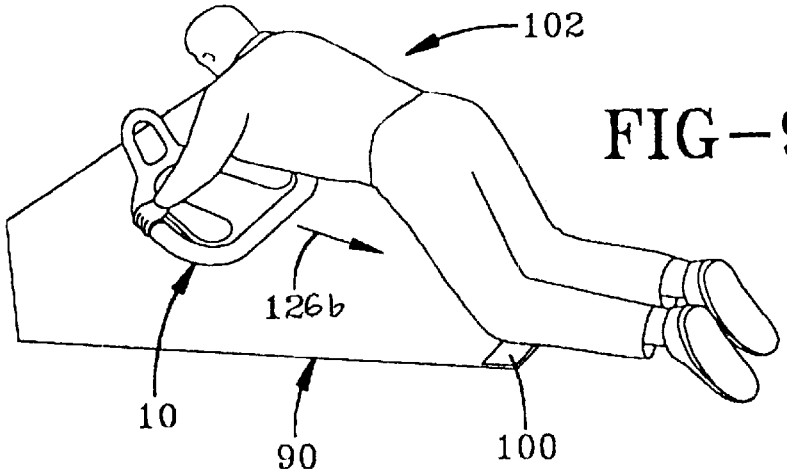
Figure 9C:
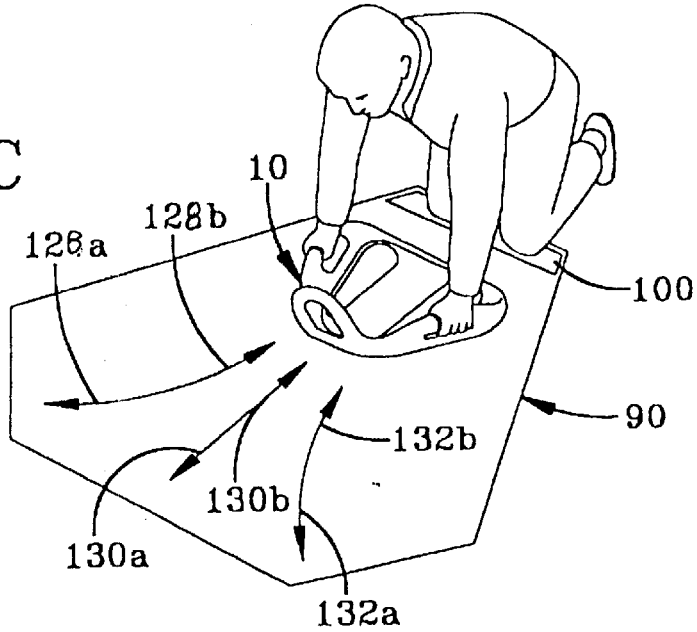

Referring to FIGS. 9A–9C, another method of using the device described above is illustrated. In this method, the device 10 is positioned on a sheet polyethylene or polypropylene mat shown generally at numeral 90. A kneepad 100 is positioned on the mat 90 adjacent the narrow base side 92. A user 102 assumes an arched back position and extends his/her forearms 104 and 106 downwardly. The user 102 is thereby able to grip hand grips 26 and 28 on lateral raised sections 18 and 20 respectively with his/her hands 108 and 110, respectively. The user's knees 112 and 114 remain in a stationary position on the kneepad 100. In the first step in the method of using the device 10, the user moves forward generally in the direction of the centerline of his/her body as at arrow 126A in FIG. 9A. At the completion of this step, the user 102 will have extended his/her body from the arched back position shown in FIG. 9A to the extended, nearly prone position shown in FIG. 9B. Once having reached the extended, nearly prone position shown in FIG. 9B, the user then slides the device rearwardly in the direction of arrow 126B along the centerline of his/her body until the arched back position shown in FIG. 9C is reached. Upon reaching this arched back position, the user then extends the device laterally and forwardly to the right of arrow 126A and the centerline of his/her body in the direction of arrow 128A until the extended nearly prone position is again reached after which the user again slides the device 10 rearwardly in the direction of arrow 128B to the arched back position. The user then again extends the device 10 in a forward direction along the centerline of his/her body in the direction of arrow 130A. After the extended nearly prone position is reached, the user then again moves the device 10 rearwardly in the direction of arrow **130*b* to the arched back position. Next, the user extends the device 10 forwardly and laterally at an angle to the left of arrow 130A and the centerline of his/her body in the direction of arrow 132A. Again, when the extended, nearly prone position is reached, the user moves the device rearwardly in the direction of the reverse arrow 132B**.

Figure 10A:
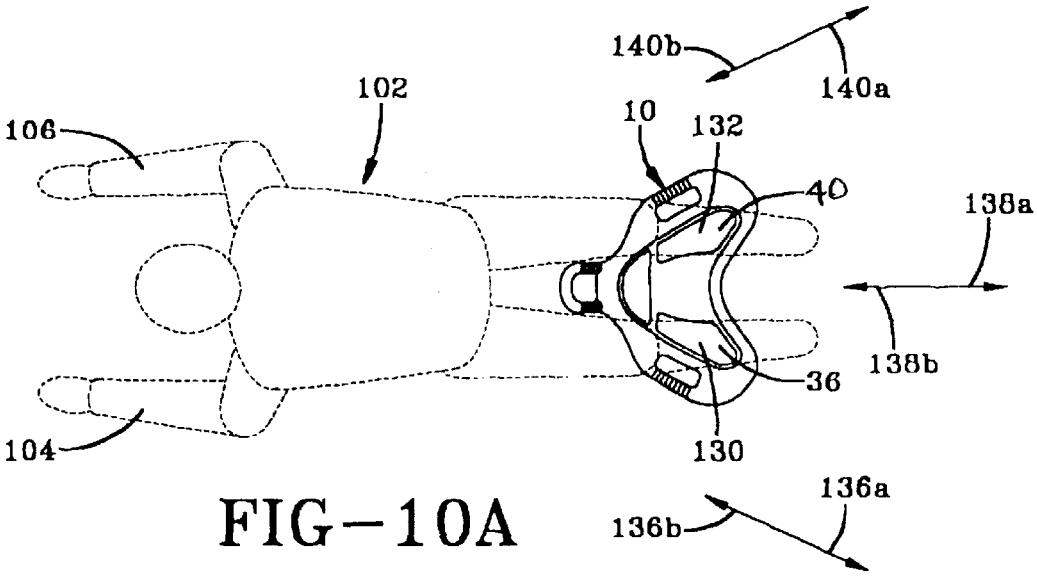
FIGS. 10A–10C are schematic illustrations of an alternate preferred method of using the exercise device shown in FIG. 1.
Figure 10B:
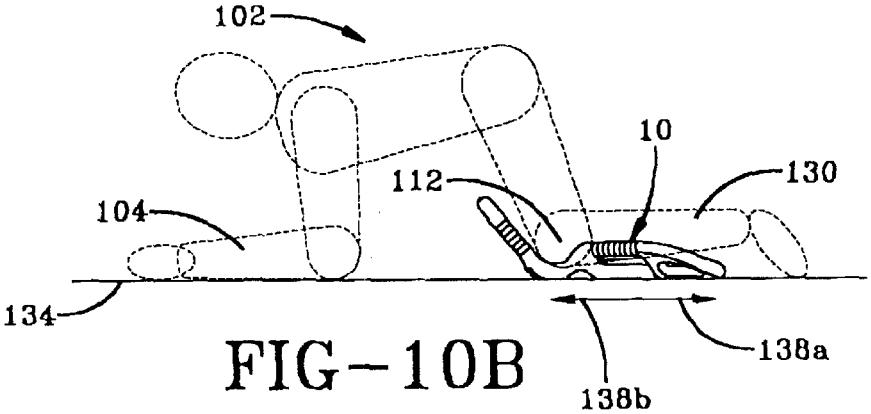
Figure 10C:
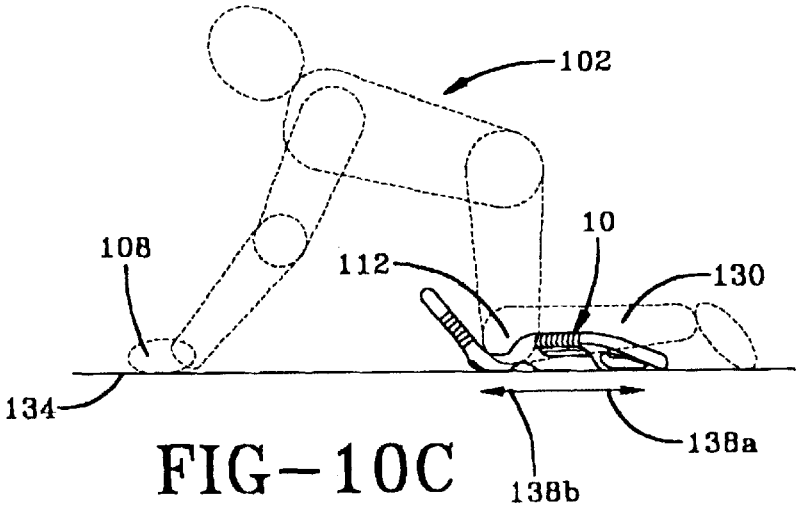

Referring to FIGS. 10A–10C, still another method of using the device of the present invention to exercise abdominal muscles is illustrated. In this method, the user positions the lower part of his/her body on the device 10 so that his/her knees 112 and 114 and shins 130 and 132 are on the limb support areas 36 and 38 of the device respectively as is particularly shown in FIGS. 10A and 10B. The front part of the body of the user 102 is stationary so that, for example, his/her forearms 104 and 106 rest on a stationary surface 134. As is shown in FIG. 10C, an alternative method for performing this exercise would be for the user to place his/her hands as at hand 108 on the surface 134. In performing the exercise according to this method, the user would first slide the device 10 rearwardly and laterally in the direction of arrow 136A. After the device 10 has been extended to a position where the user is in a nearly prone position, the user slides the device 10 inwardly and forwardly in the direction of arrow 136B. The user then extends the device 10 rearwardly along the centerline of his/her body in the direction of arrow 138A, and after the device has been extended to its rearward position, the user slides the device inwardly in the direction of arrow 138B. After this arched back position has again been reached, the user 102 slides the device 10 rearwardly and laterally in the direction of arrow 140A, and after the device has been extended it is slid inwardly and forwardly in the direction of arrow 140B. This sequence of moving the device rearwardly along the centerline of the user's body, as well as to the left and right of the centerline of his/her body may be repeated a plurality of times.

Figure 11A:
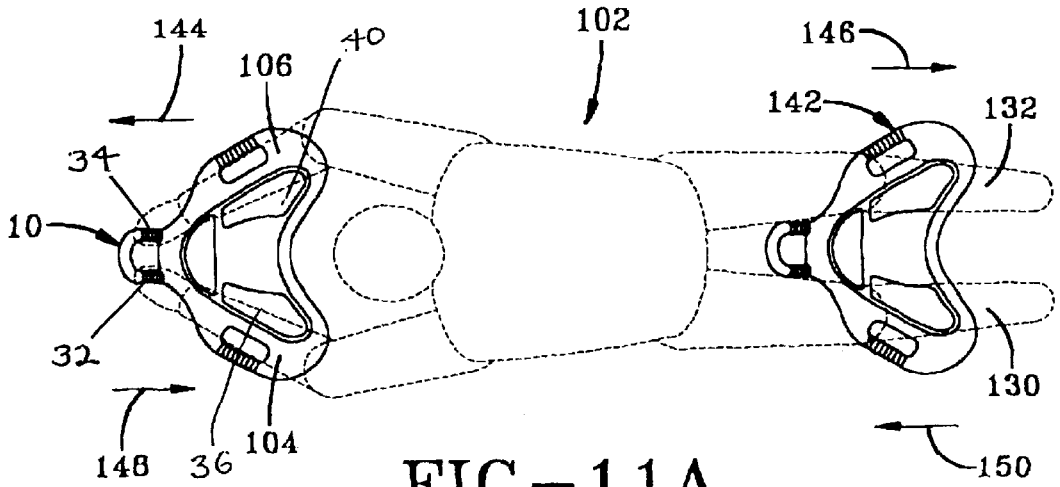
FIGS. 11A–11C are schematic illustrations of an alternate preferred method of using the exercise device shown in FIG. 1.
Figure 11B:
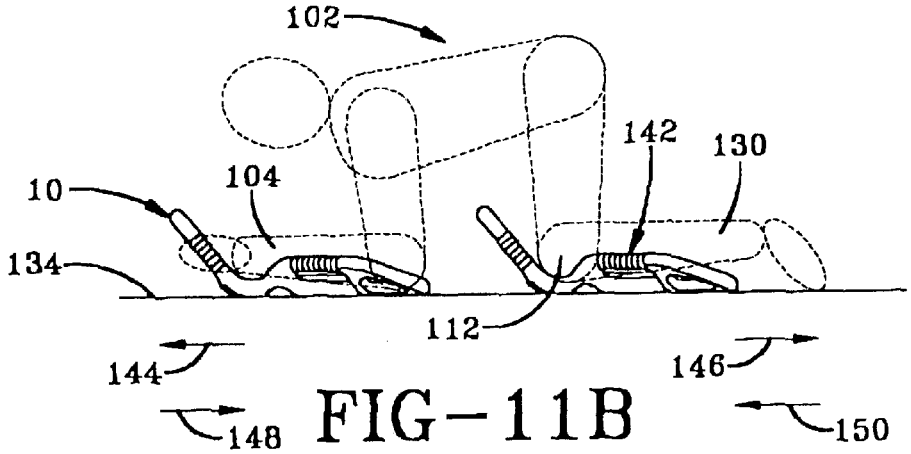
Figure 11C:
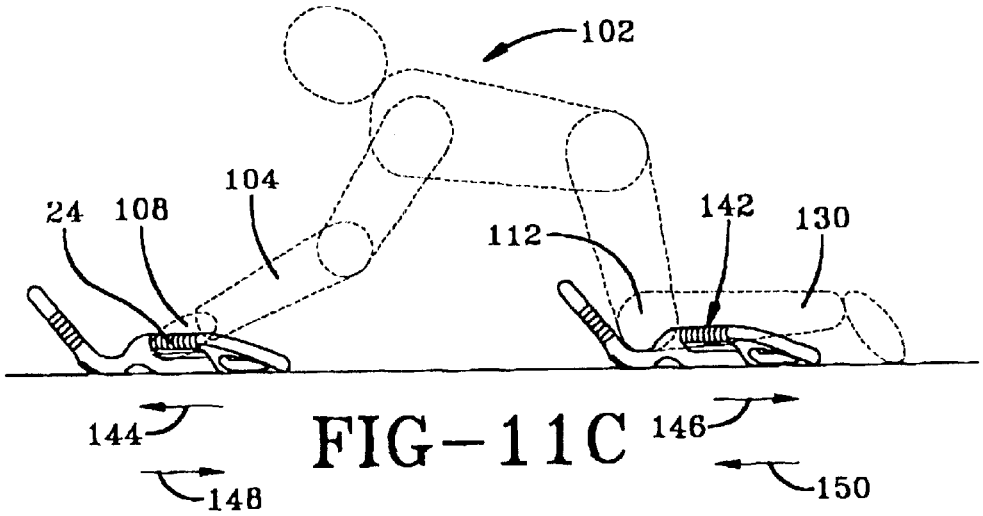

Another method of using the device 10 is shown in FIGS. 11A–11C. Referring particularly to FIGS. 11A and 11B, a user 102 may position his/her forearms 104 and 106 on the limb support areas 32 and 38 respectively of the device 10. The user would also grip front hand grips 32 and 34 in the way described above. In this method, the user also places the lower half of his/her body on a second device 142 which is substantially identical to device 10 so that his/her knees 112 and 114 and shins 130 and 132 would be positioned in the way described above in connection with FIGS. 10A and 10B. The user would then move from an arched back position as is shown in FIG. 11B to an extended, nearly prone position by moving device 10 in the direction of arrow 144 and device 142 in the direction of arrow 146. After both devices have been extended, the user would then move device 10 inwardly in the direction of arrow 48 and device 142 inwardly in the direction of arrow 150 until he/she reached the arched back position shown in FIG. 11B again. It will be understood that this exercise may be repeated a plurality of times. It will also be understood that rather than resting his/her forearms 104 and 106 on the device 10 as is shown in FIGS. 11A and 11B, the user 102 may alternatively grip the device 10 with his/her hands 108 on handgrips as at handgrip 24.

Figure 12A:
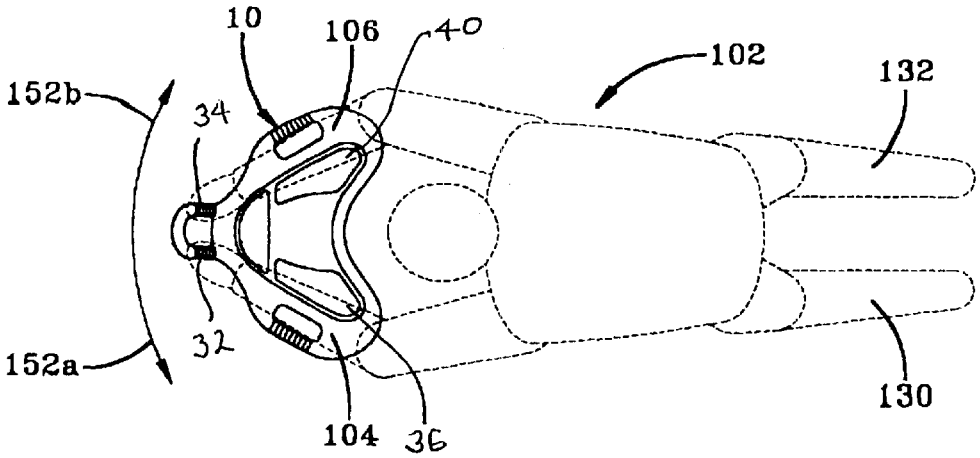
FIGS. 12A–12C are schematic illustrations of an alternate preferred method of using the exercise device shown in FIG. 1.
Figure 12B:
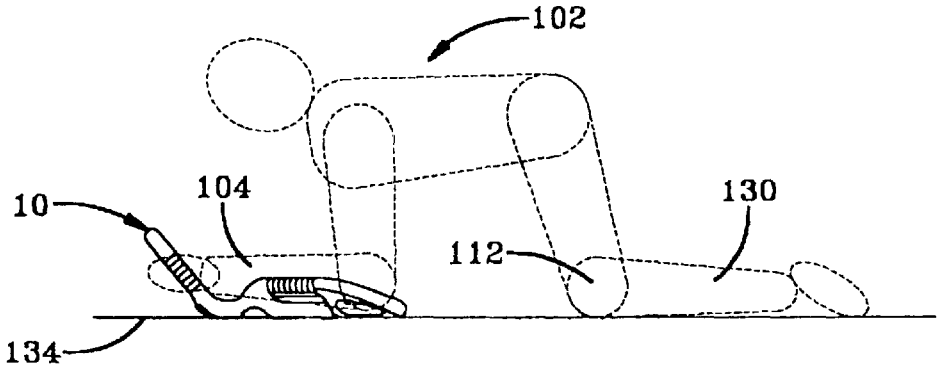
Figure 12C:
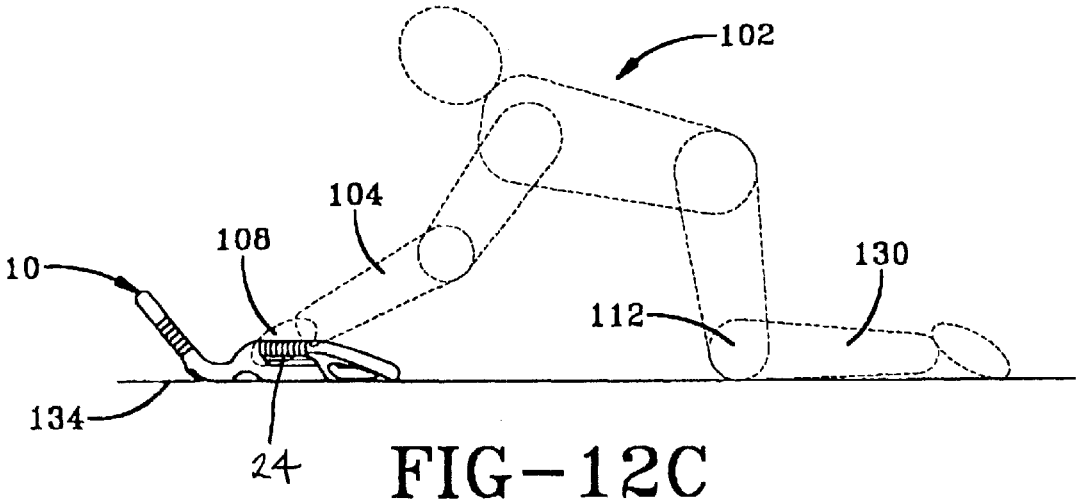

Another method of using the device 10 to perform an abdominal exercise is shown in FIGS. 12*a*–12*c*. Referring particularly to FIGS. 12A and 12B, the user would grip the front hand grips 32 and 34 and rest his/her forearms 104 and 106 respectively on the limb supports 36 and 40 respectively of the device 10. The user's knees 112 and 114 and shins 130 and 132 would be stationarily positioned on surface 134. With the front part of his/her body, the user 102 would then slide the device 10, first laterally to the left in an arcuate path in the direction of 152A and then laterally to the right in an arcuate path in the direction of 152B. This motion may be repeated a plurality of times. It will also be appreciated that instead of positioning his/her forearms as at 104 and 106 on the device, the user 102 can grip the lateral hand grips as at grip 24 with his/her hands as at hand 108 on the device 10 as is shown in FIG. 12C. The method of performing this exercise would be the same thereafter as is illustrated in FIGS. 12A and 12B.

Figure 13A:
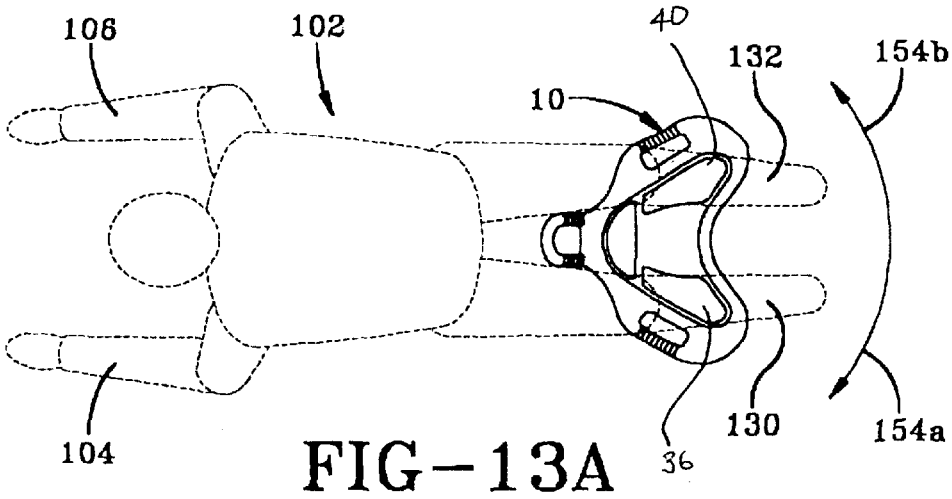
FIGS. 13A–13C are schematic illustrations of an alternate preferred method of using the exercise device shown in FIG. 1.
Figure 13B:
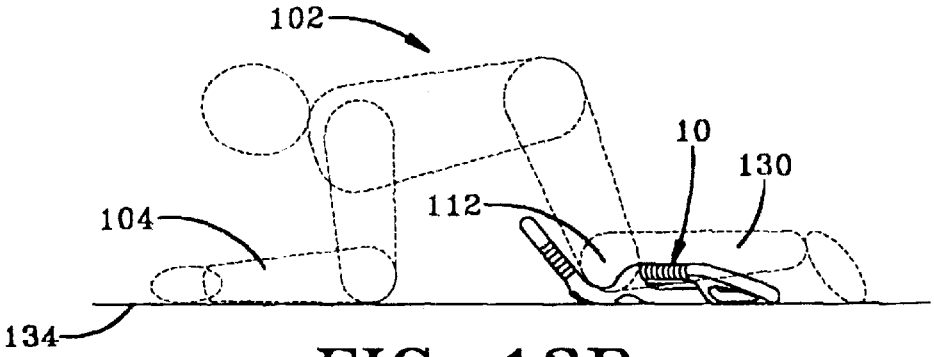
Figure 13C:
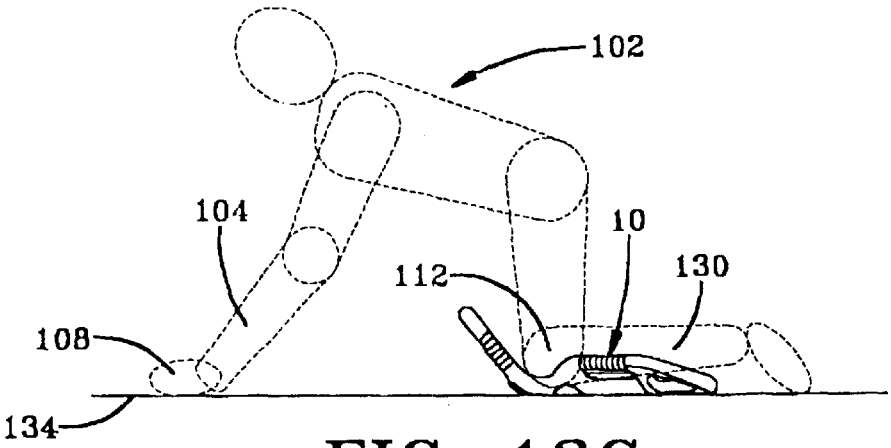
Figure 14:
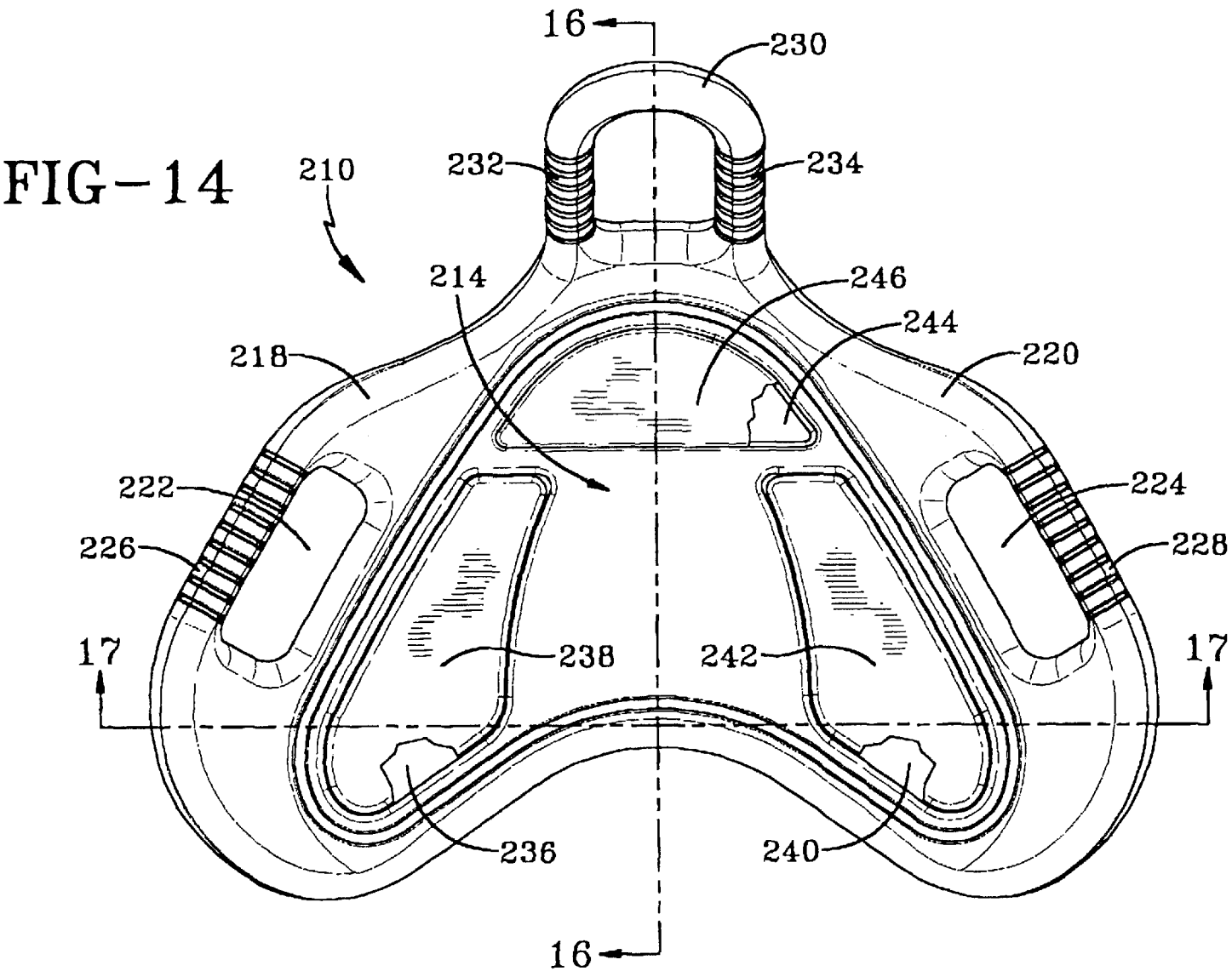
FIG. 14 is a top plan view of an exercise device representing an alternate preferred embodiment of the present invention.
Figure 15:
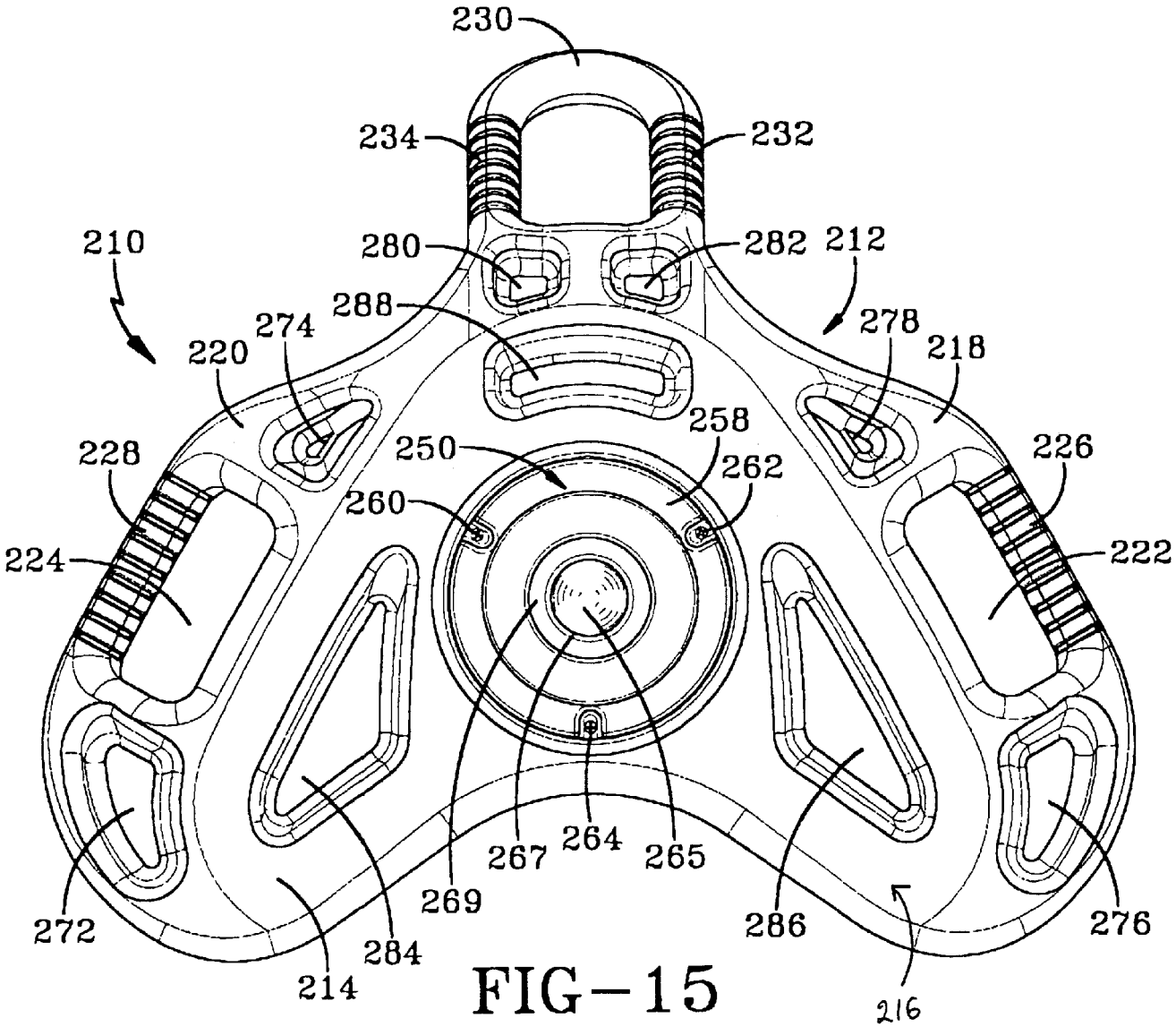
FIG. 15 is a bottom plan view of the exercise device shown in FIG. 14.
Figure 16:
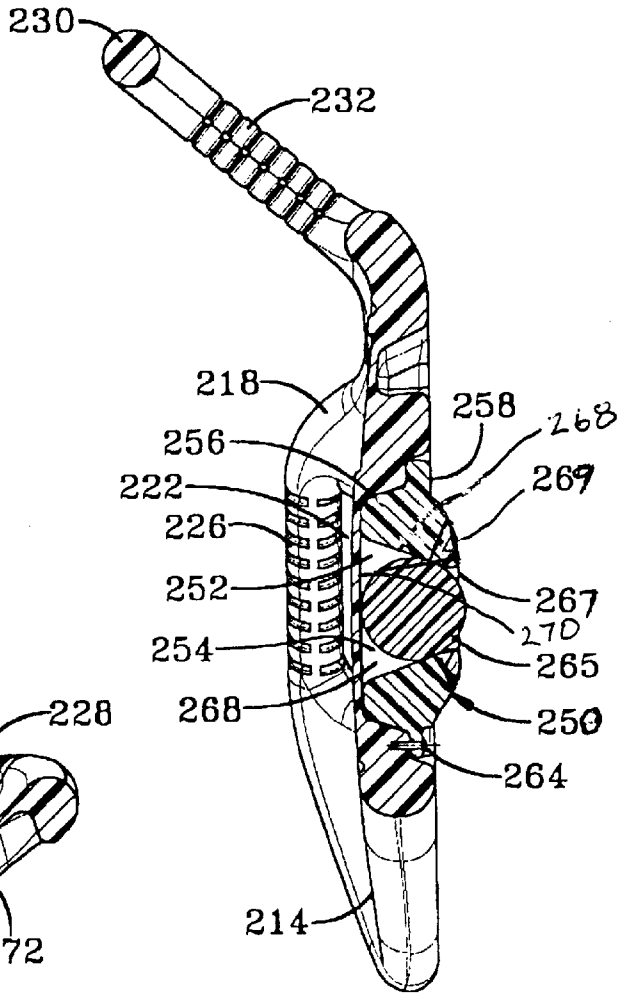
FIG. 16 is a cross sectional view through 16—16 in FIG. 14.
Figure 17:
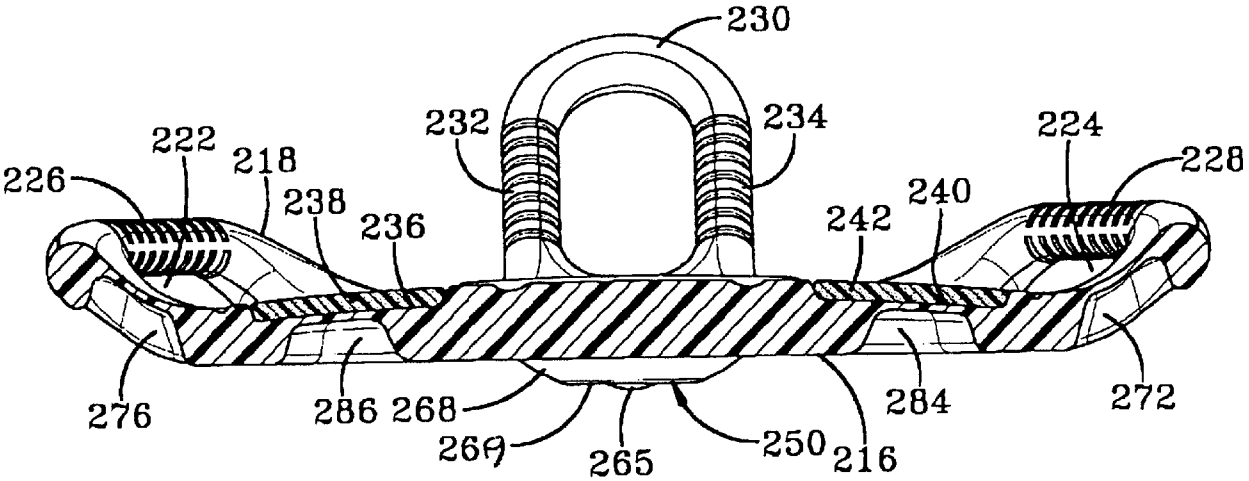
FIG. 17 is a cross sectional view through 17—17 in FIG. 4.

Another method of performing abdominal exercises with device 10 is illustrated in FIGS. 13A–13C. In this method, the user 102 positions his/her knees 112 and 114 and shins 130 and 132 on the limb support areas 36 and 48 of the device 10 respectively as is particularly shown in FIGS. 13A and 13B. The user also positions his/her forearms 104 and 106 on the stationary surface 134 in the manner described above in connection with FIGS. 10A and 10C. After position his/her body in this way, the user uses the lower part of his/her body to move the device 10 in an arcuate path laterally to the left in the direction of arrow 154A and then in an arcuate path laterally to the right in the direction of arrow 154B. This exercise may be repeated a plurality of times. Further, it will be understood that rather than positioning his/her forearms 104 and 106 on stationary surface 134 it would be possible for the user to position his/her hands as at hand 108 on the stationary surface 134 as is shown in FIG. 13C. The exercise would then be conducted in the same way as is shown in connection with FIGS. 13A and 13B.

Referring to FIGS. 14–17, the device shown generally at numeral 210 comprises a platform 212 having an upper surface 214 and a lower surface 216. At the sides of the platform 212, lateral raised sections 218 and 220 extend upwardly and outwardly. Lateral raised sections 218 and 220 have respectively lateral apertures 222 and 224 which form respectively lateral hand grips 226 and 228 on the lateral raised sections 218 and 220. Also extending upwardly and outwardly from the upper surface 214 there is a front arc 230 on which there are opposed front hand grips 232 and 234. Adjacent the lateral raised section 218 on the upper surface there is a recessed limb support area 232 on which a limb support pad 238 is superimposed. Adjacent the lateral raised section 220 on the upper surface 214 there is a recessed limb support area 240 on which a limb support pad 242 is superimposed. On the upper surface 214 there is also a front recessed hand support area 244 on which a front hand pad 246 is superimposed. On the lower surface 216 of the platform 212 there is an attachment recess 248 on which a roller attachment 250 is attached.

This roller attachment 250 has an interior central recess 252 which has an upwardly sloped peripheral wall 254. An inner shoulder 256 extends concentrically outwardly from the upwardly sloped peripheral wall 254. At the outer peripheral edge of the slide attachment 250, there is a peripheral rim 258. The sliding attachment 250 is fixed to the platform 212 by means of plastic fasteners 260, 262 and 264 which extend through this peripheral rim 258. On the lower side of the sliding attachment 250, there is a ball 265 positioned in an aperture 267 and is retained by a retention ring 269. There is a peripheral downwardly sloped surface 268 interposed between the retention ring 269 and the peripheral rim 258. The entire roller attachment rests on a recessed base surface 270 on the platform 212. On the lower surface 216 of the platform 212, there are also lateral ridge recesses 272, 274, 276 and 278. There are also front recesses 280 and 282 on the lower surface 216 of the platform 212 as well as bottom base recesses 284, 286 and 288.

It will be understood that the methods described above may all be practiced with the device 10, either with or without the sliding attachment 50 or with the device 210 having the roller attachment 250 with the ball 265.

It will be appreciated that there has been described an exercise device and a method for its use which is adapted to exercise abdominal muscles both along the plane of the centerline of the user's body and to the left and right of such centerline. Such range of motion will facilitate the exercise of all the major abdominal muscle groups as well as other muscle groups.

It will also be appreciated that the present invention provides an exercise device where the user may easily grip it a number of ways with both hands in a mutually supporting manner.

It will also be appreciated that the present invention is adapted to allow the user to participate in a number of different types of exercises to provide a full range of abdominal muscle exercises as well as to providing a variety in the exercise routine.

It will also be appreciated that the present invention is an abdominal exercise device which may be easily and inexpensively manufactured.

It will also be appreciated that this exercise device may be easily be used at home and it is compact and adapted to storage in a space efficient manner when not in use.

It will also be appreciated that the device described above is sufficiently compact so that it may be readily carried by the user to allow exercising while traveling.

Accordingly, the improved ABDOMINAL EXERCISE DEVICE is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the ABDOMINAL EXERCISE DEVICE is constructed and used, the characteristics of the construction, and the advantageous new and useful results obtained; the new and useful structures, devices, elements, arrangements, parts, and combinations are set forth in the appended claims.

What is claimed is:

1. A device for exercising abdominal or other muscles of a user having a pair of hands and a body centerline, said device comprising:

a freely movable platform having an upper surface and a lower surface and adapted to be moved on said lower surface;

means on said upper surface for allowing said user to grip said platform with both hands;

means on said lower surface of the platform which is adapted to be movable in a forward and a reverse motion in a first direction aligned with the body centerline of the user, in at least a second direction angularly disposed to the body centerline of the user and in at least a third direction at about ninety degrees to the body centerline of the user;

wherein the platform slides on a substrate or rolls on the substrate so that the user may exercise abdominal or other muscles both along the body centerline of the user and laterally to said body centerline, said platform being adapted to be movable in the first, second and third direction without the user having to substantially alter one of their grip on the handle means and the orientation of the platform relative their body centerline.

2. The device of claim 1 wherein the platform is adapted for omni-directional motion.

3. The device of claim 1 wherein there are handle means on said platform which are disposed in intersecting relation to the upper surface of the platform.

4. The device of claim 1 wherein the handle means comprise opposed lateral hand grips.

5. A device for exercising abdominal or other muscles of a user having a pair of hands and a body centerline, said device comprising:

a freely movable platform having an upper surface and a lower surface and adapted to be moved on said lower surface;

a pair of front hand grips disposed on said upper surface for allowing said user to grip said platform with both hands;

means on said lower surface of the platform which is adapted to be movable in a forward and a reverse motion in a first direction aligned with the body centerline of the user and angularly disposed to the body centerline of the user in at least a second direction;

wherein the platform slides on a substrate or rolls on the substrate by means of a ball mounted on the lower surface of the platform so that the user may exercise abdominal or other muscles both along the body centerline of the user and laterally to said body centerline.

6. A device for exercising abdominal or other muscles of a user having a pair of hands and a body centerline, said device comprising:

a freely movable platform having an upper surface and a lower surface and adapted to be moved on said lower surface;

opposed lateral hand grips and a pair of front hand grips disposed on said upper surface for allowing said user to grip said platform with both hands;

means on said lower surface of the platform which is adapted to be movable in a forward and a reverse motion in a first direction aligned with the body centerline of the user and angularly disposed to the body centerline of the user in at least a second direction;

wherein the platform slides on a substrate or rolls on the substrate by means of a ball mounted on the lower surface of the platform so that the user may exercise abdominal or other muscles both along the body centerline of the user and laterally to said body centerline.

7. A device for exercising abdominal or other muscles of a user having a body centerline, the device comprising:

a platform having an upper surface and a lower surface, wherein said upper surface has a limb supporting area and a pair of hand grips extending upwardly from said upper surface and said lower surface is adapted to facilitate forward and reverse motion of the platform in a first direction aligned with the body centerline of the user, and in at least one additional direction angularly disposed to said first direction;

wherein the platform omni-directionally slides on a substrate or rolls on the substrate and wherein the user may slide or roll the platform on the substrate without substantially altering the position of their hands.

8. The device of claim 7 wherein the platform is adapted for omni-directional motion.

9. A device for exercising abdominal or other muscles comprising:

a platform having an upper surface and a lower surface adapted for omni-directional motion;

a pair of lateral hand grips each of said pair of lateral hand grips extending from the upper surface of the platform and disposed in opposed relation laterally and outwardly from one of said limb supporting areas; and a front hand grip extending from the upper surface of the platform and disposed generally forward of the limb supporting areas, wherein the platform slides on a substrate or rolls on the substrate by means of a ball mounted on the lower surface of the substrate.

10. The device of claim 9 wherein the platform is adapted for omni-directional motion.

11. The device of claim 9 wherein the lateral hand grips extend generally upwardly from the upper surface.

12. The device of claim 9 wherein the front hand grip extends generally upwardly from the upper surface.

13. A method of facilitating exercise of abdominal or other muscles on a stationary substrate by a person having a body centerline, a back, a pair of hands, a pair of forearms, and a pair of knees, comprising the steps of:

(a) providing a platform having an upper surface and a lower surface, wherein said upper surface has hand receiving means for both of said hands or forearm receiving means of both of said forearms of said person and said lower surface is adapted for motion on said substrate in a plurality of directions;

(b) then causing the person to engage the hand receiving means with both of said hands or to engage the forearm receiving means with both of said forearms and to position said knees in a stationary position on the substrate in an arched back position;

(c) then causing the person to move the platform on said stationary substrate in a forward direction generally coplanar with said body centerline to an extended back position;

(d) then causing the person to move the platform on said stationary substrate in a rearward direction generally opposite to said direction traveled in step (c) to an arched back position;

(e) then causing the person to move the platform on the stationary substrate in a generally forward direction which is angularly disposed to the direction traveled in step (c) and to said body centerline of the person to an extended back position;

(f) then causing the person to move the platform on said stationary substrate in a rearward direction generally opposite to said direction traveled in step (e) to an arched back position;

(g) causing the person to move the platform on the stationary substrate in a generally forward direction which is angularly disposed to the body centerline of the person and in opposed relation to the direction traveled in step (e) relative to said centerline; and (h) then causing the person to move the platform on said stationary substrate in a generally rearward direction generally opposite to said direction traveled in step (g);.

wherein the person slides the platform on the stationary substrate or rolls the platform on the stationary substrate by means of a ball mounted on the lower surface of the platform.

14. The method of claim 13 wherein the platform is adapted for omni-directional motion on the substrate.

15. A method of facilitating exercise on a stationary substrate by a person having a body centerline, a back, a pair of hands, a pair of forearms, a pair of knees and a pair of shins, comprising the steps of:

(a) providing a substantially planar platform having an upper surface and a lower surface, wherein said upper surface has a limb receiving pad for both of said knees and shins and said lower surface is adapted for omni-directional motion on said substrate by sliding on said substrate or rolling on a ball mounted on said lower surface;

(b) then causing the person to position said hands or said forearms on the stationary substrate and to position said knees on said limb receiving means in an arched back position;

(c) then causing the person to move the platform on said stationary substrate in a rearward direction generally coplanar with said body centerline to an extended back position;

(d) then causing the person to move the platform on said stationary substrate in a forward direction generally opposite to said direction traveled in step (c) to an arched back position;

(e) then causing the person to move the platform on the stationary substrate in a generally rearward direction which is angularly disposed to the direction traveled in step (c) and to said body centerline to an extended back position;

(f) then causing the person to move the platform on said stationary substrate in a forward direction generally opposite to said direction traveled in step (e) to an arched back position;

(g) causing the person to move the platform on the stationary substrate in a generally rearward direction which is angularly disposed to the body and the centerline of said person in opposed relation to the direction traveled in step (e) relative to said centerline;

(h) then causing the person to move the platform or said stationary substrate in a forward direction generally opposite to said direction traveled in step (g);

wherein the person slides the platform on the stationary substrate or rolls the platform on the stationary substrate by means of a ball mounted on the lower surface of the platform.

16. The method of claim 15 wherein after step (f) there are additional steps of (g) causing the person to move the platform on the stationary substrate in a generally rearward direction which is angularly disposed to the body and the centerline of said person in opposed relation to the direction traveled in step (e) relative to said centerline; and (h) then causing the person to move the platform or said stationary substrate in a forward direction generally opposite to said direction traveled in step (g).

17. The method of claim 16 wherein the platform slides on a substrate.

18. A method of facilitating exercise on a stationary substrate by a person having a body centerline, a back, a pair of hands, a pair of forearms, and a pair of knees, comprising the steps of:

(a) providing a platform having an upper surface and a lower surface, wherein said upper surface has hand receiving means for both of said hands or forearm receiving means of both of said forearms of said person and said lower surface is adapted for motion on said substrate in a plurality of directions;

(b) providing a platform having an upper surface and a lower surface, wherein said upper surface has a limb receiving means and said lower surface is adapted for motion on said substrate;

(c) then causing the person to engage the hand receiving means of the platform provided in step (a) with both of said hands or to engage the forearm receiving means with both of said forearms and to position said knees in a stationary position on the substrate in an arched back position;

(d) then causing the person to engage the knee receiving means of the platform provided in step (b) with both of said knees or shins;

(e) then causing the person to move the platform provided in step (a) on said stationary substrate in a forward direction generally coplanar with said body centerline and causing the person to move the platform provided in step (b) on said stationary substrate in a rearward direction generally planar with the body centerline to an extended back position; and (f) then causing the person to move the platform provided in step (a) on said stationary substrate in a rearward direction and causing the person to move the platform provided in step (b) on said stationary substrate in a forward direction to an arched back position;

wherein the person slides the platform on the stationary substrate or rolls the platform on the stationary substrate by means of a ball mounted on the lower surface of the platform.

19. The method of claim 18 wherein the platform slides on a substrate.

20. The method of claim 18 wherein the platform is adapted for omni-directional motion on the substrate.

21. A method of facilitating exercise on a stationary substrate by a person having a body centerline, a back, a pair of hands, a pair of forearms, and a pair of knees, comprising the steps of:

(a) providing a platform having an upper surface and a lower surface, wherein said upper surface has hand receiving means for both of said hands or forearm receiving means of both of said forearms of said person and said lower surface is adapted for motion on said substrate in a plurality of directions;

(b) then causing the person to engage the hand receiving means with both of said hands or to engage the forearm receiving means with both of said forearms and to position said knees in a stationary position on the substrate in an arched back position;

(c) then causing the person to move the platform on said stationary substrate arcuately in a lateral direction to one side of said body; and (d) then causing the person to move the platform on said stationary substrate arcuately in a lateral direction generally opposite to said direction traveled in step (c);

wherein the person slides the platform on the stationary substrate or rolls the platform on the stationary substrate by means of a ball mounted on the lower surface of the platform.

22. The method of claim 21 wherein the platform is adapted for omni-directional motion on the substrate.

23. A method of facilitating exercise on a stationary substrate by a person having a body centerline, a back, a pair of hands, a pair of forearms, and a pair of knees, comprising the steps of:

(a) providing a substantially planar platform having an upper surface and a lower surface, wherein said upper surface has a limb receiving pad for both of said knees and shins and said lower surface is adapted for omni-directional motion on said substrate in a plurality of directions by sliding on said substrate or rolling a ball mounted on said lower surface;

(b) then causing the person to position said hands or said forearms on the stationary substrate and to position said knees on said knee receiving means;

(c) then causing the person to move the platform on said stationary substrate arcuately in a lateral direction to one side of said body centerline; and (d) then causing the person to move the platform on said stationary substrate arcuately in a lateral direction generally opposite to said direction traveled in step (c);

wherein the person slides the platform on the stationary substrate or rolls the platform on the stationary substrate by means of a ball mounted on the lower surface of the platform.

24. A device for exercising abdominal or other muscles of a user having a pair of hands and a body centerline, said device comprising:

a freely movable platform having an upper surface and a lower surface and adapted to be moved on said lower surface; and means on said upper surface for allowing said user to grip said platform with both hands; and means on said lower surface of the platform which is adapted to be movable in a forward and a reverse motion in a first direction aligned with the body centerline of the user, in a second direction angularly disposed to the body centerline of the user and in a third direction disposed generally perpendicular to the body centerline of the user;

wherein the platform slides or rolls on the substrate omni-directionally so that the user may exercise abdominal or other muscles both along the body centerline of the user and laterally to said body centerline without altering the user's grip relative to the orientation of the platform.

25. A device for exercising abdominal or other muscles of a user having a body centerline, the device comprising:

a platform having an upper surface and a lower surface, wherein said upper surface has a limb supporting area and a pair of hand grips extending upwardly from said upper surface and said lower surface is adapted to facilitate forward and reverse motion of the platform in a first direction aligned with the body centerline of the user, in a second direction angularly disposed to said first direction and in at least a third direction disposed at about right angles to the user's body centerline;

wherein the platform rolls or slides omni-directionally on the substrate so that the user may exercise abdominal or other muscles both along the body centerline of the user, laterally to said body centerline and at about ninety degrees to said body centerline, without adjusting the their grip on the platform relative to platform's orientation to their body centerline.

26. A device for exercising abdominal or other muscles comprising:

a platform having an upper surface and a lower surface adapted for omni-directional motion;

a pair of lateral hand grips each of said pair of lateral hand grips extending from the upper surface of the platform and disposed in opposed relation laterally and outwardly from one of said limb supporting areas; and a front hand grip extending from the upper surface of the platform and disposed generally forward of the limb supporting areas, wherein the platform rolls on the substrate by means of a ball mounted on the lower surface of the substrate.

27. A device for exercising abdominal or other muscles of a user having a pair of hands and a body centerline, said device comprising:

a generally planar platform having an upper surface and a lower surface adapted for omni-directional motion and a rear edge and a first and a second lateral edge converging at a front apex;

a first and a second lateral hand grip extending upwardly respectfully from adjacent the first and second lateral edges of the platform;

a first and a second limb supporting pad positioned on the upper surface of the platform adjacent respectfully to the first and second lateral edges of the platform and said first and second limb supporting pads being positioned in generally converging relation with respect to each other; and a front hand grip extending upwardly adjacent the front apex.

28. The device of claim 27 wherein the lower surface of the platform is adapted for sliding motion on a substrate.

29. The device of claim 27 wherein the lower surface is adapted for rolling motion by means of a ball mounted thereon.

30. The device of claim 29 wherein there is a recess in the lower surface of the platform and the ball is mounted in said recess.

31. The device of claim 30 wherein the ball is retained in the recess by a ring.

32. The device of claim 27 wherein the lower surface is adapted for omni-directional motion by means of a roller assembly fixed thereto, wherein said roller assembly fits into a central recess in the lower surface of the platform and said roller assembly has a peripheral shoulder resting on the platform and forming a central aperature and a ball is positioned in said central aperature and is retained therein by a ring fixed to the peripheral shoulder.

33. A device for exercising abdominal or other muscles of a user having a pair of hands and a body centerline, said device comprising:

a freely movable platform having an upper surface and a lower surface and adapted to be moved on said lower surface;

means on said upper surface for allowing said user to grip said platform with both hands;

movement means on said lower surface of the platform, whereby said platform is adapted to be moved along a substrate in substantially any direction relative to the body centerline of the user without the user altering their position of the platform relative to their body centerline.

34. The device of claim 33, wherein the movement means is rotatable in a plurality of directions so that the platform may be rolled along the substrate in substantially any direction relative the body centerline of the user without the user altering the position of the platform relative to their body centerline.

35. The device of claim 33, wherein the movement means is a sliding attachment, wherein the sliding attachment allows the platform to be slid along the substrate in substantially any direction relative to the body centerline of the user without the user altering the position of the platform relative to their body centerline.

36. The device of claim 33, wherein the handle means comprise opposed lateral hand grips.

37. The device of claim 33, wherein the handle means comprise a pair of front hand grips.

38. The device of claim 33, wherein the handle means comprise opposed lateral hand grips and a pair of front hand grips.

39. A device for exercising abdominal or other muscles of a user having a body centerline, said device comprising:

a platform having an upper surface and a lower surface, wherein said upper surface has a limb supporting area and a pair of hand grips extending upwardly from said upper surface and said lower surface is adapted to facilitate omni-directional sliding or rolling motion relative to the body centerline of the user.

40. The device of claim 39 wherein the pair of hand grips extend from the upper surface of the platform disposed in opposed relation laterally and outwardly from the limb supporting area.

41. The device of claim 40 further comprising a pair of front hand grips extending upwardly from the upper surface of the platform and disposed generally forward of the limb supporting area.

42. A method of facilitating exercise of abdominal or other muscles on a stationary substrate by a person having a body centerline, a back, a pair of hands, a pair of forearms and a pair of knees, the method comprising the steps of:

(a) providing a platform having an upper surface and a lower surface, wherein said upper surface has hand receiving means for both of said hands or forearm receiving means for both of said forearms of said person and said lower surface is adapted for motion on said substrate in a plurality of directions;

(b) engaging the hand receiving means with both hands or engaging the forearm receiving means with both forearms;

(c) positioning the knees in a stationary position on the substrate in an arched back position;

(d) moving the platform on the substrate in a forward direction generally coplanar with the body centerline to an extended back position;

(e) moving the platform on the substrate in a rearward direction generally opposite to the direction traveled in step (d) to an arched back position;

(f) moving the platform on the substrate in a generally forward direction which is angularly disposed to the direction traveled in step (d) and to the body centerline of the person to an extended back position;

(g) moving the platform on the substrate in a rearward direction generally opposite to the direction traveled in step (f) to an arched back position;

(h) moving the platform on the substrate in a generally forward direction that is angularly disposed to the body centerline of the person and in opposed relation to the direction traveled in step (f) relative to the centerline; and (i) moving the platform on the substrate in a generally rearward direction generally opposite to the direction traveled in step (h);

wherein the person slides the platform on the stationary substrate or rolls the platform on the stationary substrate by way of an omni-directional movement means disposed on the lower surface of the platform.

43. A method of facilitating exercise of abdominal or other muscles on a stationary substrate by a person having a body centerline, a back, a pair of hands, a pair of legs and a pair of knees, the method comprising the steps of:

(j) providing a platform having an upper surface and a lower surface, wherein said upper surface has hand receiving means for both of said hands or limb receiving means for receiving the legs and knees of said person and said lower surface is adapted for motion on said substrate in a plurality of directions;

(k) positioning the legs and knees on the limb receiving means;

(l) positioning the hands in a stationary position on the substrate in an arched back position;

(m) moving the platform on the substrate in a forward direction generally coplanar with the body centerline to an extended back position;

(n) moving the platform on the substrate in a rearward direction generally opposite to the direction traveled in step (d) to an arched back position;

(o) moving the platform on the substrate in a generally forward direction which is angularly disposed to the direction traveled in step (d) and to the body centerline of the person to an extended back position;

(p) moving the platform on the substrate in a rearward direction generally opposite to the direction traveled in step (f) to an arched back position;

(q) moving the platform on the substrate in a generally forward direction that is angularly disposed to the body centerline of the person and in opposed relation to the direction traveled in step (f) relative to the centerline; and (r) moving the platform on the substrate in a generally rearward direction generally opposite to the direction traveled in step (h);

wherein the person slides the platform on the stationary substrate or rolls the platform on the stationary substrate by way of an omni-directional movement means disposed on the lower surface of the platform.

44. The device of claim 1, wherein the platform is substantially V-shaped having two sides meeting at an apex.

45. The device of claim 44, wherein the handle means are disposed proximate the apex of the V-shaped platform.

46. The device of claim 44, wherein handle means are disposed on each of the sides of the V-shaped platform.

47. The device of claim 44, wherein the handle means are disposed proximate the apex of the V-shaped platform and on each of the sides of the V-shaped platform.

* * * * *